US011896072B2

(12) United States Patent
Collinson-Smith

(10) Patent No.: US 11,896,072 B2
(45) Date of Patent: Feb. 13, 2024

(54) SWIMWEAR AND METHOD OF CUSTOMIZING SWIMWEAR

(71) Applicant: Rebecca Collinson-Smith, Minnamurra (AU)

(72) Inventor: Rebecca Collinson-Smith, Minnamurra (AU)

( * ) Notice: Subject to any disclaimer, the term of this patent is extended or adjusted under 35 U.S.C. 154(b) by 0 days.

(21) Appl. No.: 18/108,332

(22) Filed: Feb. 10, 2023

(65) Prior Publication Data

US 2023/0189903 A1 Jun. 22, 2023

Related U.S. Application Data

(63) Continuation of application No. 16/801,108, filed on Feb. 25, 2020, now abandoned.

(30) Foreign Application Priority Data

Feb. 25, 2019 (AU) ..... 2019100210

(51) Int. Cl.
*A41D 7/00* (2006.01)
*A41D 31/04* (2019.01)

(52) U.S. Cl.
CPC ..... *A41D 7/001* (2013.01); *A41D 31/04* (2019.02)

(58) Field of Classification Search
CPC ..... A41D 7/001; A41D 31/04
See application file for complete search history.

(56) References Cited

U.S. PATENT DOCUMENTS 2,183,380 A * 12/1939 Hurt ..... B29C 41/14 450/156
3,436,762 A 4/1969 Cahan
3,675,245 A * 7/1972 Follett ..... A41D 31/185 428/332
3,821,055 A 6/1974 Fairbanks et al.
4,343,044 A * 8/1982 Borda ..... D04B 21/12 2/67
4,642,250 A * 2/1987 Spector ..... G01K 11/165 446/28
4,654,894 A 4/1987 Kudo
4,916,755 A 4/1990 Feigenbaum et al.
4,978,568 A * 12/1990 Postma ..... B43L 1/08 434/408
6,292,947 B1 9/2001 Bechis
6,421,832 B1 * 7/2002 Ondrejko ..... A41D 1/04 2/69

(Continued)

FOREIGN PATENT DOCUMENTS

CN 206472873 U 9/2017

OTHER PUBLICATIONS

Wet Suits / How It's Made [Viewed on internet on May 10, 2019] Viewed on internet. <URL: https://www.youtube.com/watch?v=JkqBWJsIHLw>, Published on Jan. 10, 2016.

(Continued)

*Primary Examiner* — Richale L Quinn
(74) *Attorney, Agent, or Firm* — Myers Wolin, LLC

(57) ABSTRACT

A kit for use in creating customized swimwear is provided including an outer layer formed of a water repellent draw-on fabric, an inner layer formed from a water repellent fabric, and a plurality of fabric markets of different colors.

4 Claims, 6 Drawing Sheets

(56) References Cited

U.S. PATENT DOCUMENTS

| | | | | |
|---|---|---|---|---|
| 6,982,115 | B2 * | 1/2006 | Poulos | D06Q 1/10 428/206 |
| 7,455,725 | B2 | 11/2008 | Cordova | |
| 7,634,819 | B2 * | 12/2009 | Grey | A45D 8/36 2/207 |
| 8,037,545 | B2 * | 10/2011 | McLaughlin | G09F 21/02 2/209.12 |
| 9,150,747 | B2 * | 10/2015 | Schilo | C09D 9/005 |
| 9,943,880 | B2 * | 4/2018 | Dorf | D06P 5/002 |
| 10,264,833 | B2 * | 4/2019 | Eleish | B43L 1/002 |
| 10,905,175 | B1 | 2/2021 | Dilorenzo et al. | |
| 2002/0062512 | A1 | 5/2002 | Gustafson et al. | |
| 2004/0231671 | A1 * | 11/2004 | Begum | A61F 11/12 128/206.13 |
| 2008/0086793 | A1 * | 4/2008 | Higgins | A42B 1/248 2/209.13 |
| 2008/0124684 | A1 * | 5/2008 | Grell | G06Q 30/02 434/81 |
| 2008/0178394 | A1 * | 7/2008 | Hester | D06Q 1/02 252/79.4 |
| 2009/0205100 | A1 * | 8/2009 | Flower | A41B 9/002 2/244 |
| 2009/0280716 | A1 * | 11/2009 | Normand | A41D 27/08 446/146 |
| 2010/0064915 | A1 * | 3/2010 | Skarpetis | B32B 5/26 156/219 |
| 2011/0086335 | A1 * | 4/2011 | Rogers | B43L 15/00 434/408 |
| 2011/0314583 | A1 | 12/2011 | Scarletto | |
| 2012/0167273 | A1 * | 7/2012 | Ballinger | A41D 19/0024 2/160 |
| 2013/0047319 | A1 * | 2/2013 | Canale | A41D 20/00 2/243.1 |
| 2015/0173427 | A1 * | 6/2015 | Sawyer | A41D 7/00 2/67 |
| 2015/0327613 | A1 * | 11/2015 | Kay | A42B 1/242 2/209.13 |
| 2016/0015100 | A1 * | 1/2016 | Leto | D06N 3/0056 2/167 |
| 2016/0346895 | A1 * | 12/2016 | Dorf | B24B 7/20 |
| 2020/0268062 | A1 * | 8/2020 | Palese | A41C 3/12 |

OTHER PUBLICATIONS

Decorating a Bathing Suit / Craft Corner [Viewed on internet on May 10, 2019] Viewed on internet. <URL: https://www.youtube.com/watch?v=ZbseATJ78rM>, Published on Jun. 7, 2017.

Non-Final Office Action issued by the United States Patent and Trademark Office for U.S. Appl. No. 16/801,108, dated Aug. 31, 2021.

Final Office Action issued by the United States Patent and Trademark Office for U.S. Appl. No. 16/801,108, dated Dec. 24, 2021.

Non-Final Office Action issued by the United States Patent and Trademark Office for U.S. Appl. No. 16/801,108, dated Jun. 2, 2022.

Final Office Action issued by the United States Patent and Trademark Office for U.S. Appl. No. 16/801,108, dated Dec. 12, 2022.

* cited by examiner

SWIMWEAR AND METHOD OF CUSTOMIZING SWIMWEAR

CROSS-REFERENCE TO RELATED APPLICATION

This application is a continuation application of U.S. patent application Ser. No. 16/801,108, filed Feb. 25, 2020, which claims priority to Australian Patent Application No. 2019100210, filed on Feb. 25, 2019, the contents of the aforementioned applications are incorporated herein by reference in their entirety.

TECHNICAL FIELD

The present invention generally relates to swimwear and in particular to swimwear which enables a user to customise external design of the swimwear.

BACKGROUND

Swimwear is a type of clothing worn by users while performing water sports such as swimming, surfing, diving etc. The swimwear has been designed primarily for use in water so as to prevent them from any injury, protect the skin from sun burn while performing the aforesaid water sports. However, recently the designing of swimwear has been carried out by keeping in mind aesthetic appeal the same as well.

These days, users buy swimwear not only based on their functional characteristics, but also based on their external design to make a fashion statement. There have been a number of solutions are provided to suffice the user's evolving demands towards fashionable swimwear such as self-print fabrics where user can get print anything on their swimwear, multi-colour reflector surface, reversible swimwear etc.

Although the above-mentioned solutions and other existing techniques strive to provide customisable swimwear to satisfy the needs of users, they still have a number of limitations and shortcomings for example, the time taken to design, print and manufacture a custom made design.

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others.

Any discussion of the background art throughout the specification should in no way be considered as an admission that such background art is prior art nor that such background art is widely known or forms part of the common general knowledge in the field in Australia or worldwide.

SUMMARY

According to an aspect of the invention there is provided swimwear. The swimwear comprises an outer layer configured to display an artwork, an inner layer configured to obscure light. Further, the outer layer and inner layer are oriented in a manner to enhance appearance of the artwork on the outer layer.

The outer layer is made of fabric adapted to display the artwork. Preferably, the outer layer is of white colour.

The artwork is drawn on the outer layer by a user by using a marker. Preferably, the artwork is, but not limited to, an image, a character. Further, the marker is made of, but not limited to, non-toxic material. Also, the marker is made of a material which ensures permanency of the drawing on the outer layer of the swimwear.

The inner layer is made of fabric which obscures light from passing through the inner layer. Preferably, the inner layer is in the form of, but not limited to, a lining and is of black colour.

It is an advantage of the invention that there is offered flexibility to the users to customise his/her swimwear according to his/her choice of artwork. Further, the marker enables the user to draw the artwork easily. Also, the pre-determined orientation of the outer layer and the inner layer of the swimwear displays the artwork appropriately with enhanced appearance.

According to another aspect of the invention there is provided a method of customising swimwear. The method comprising the steps of providing the swimwear having an outer layer and an inner layer, drawing an artwork on the outer layer of the swimwear. In a less preferred embodiment the method includes heating the outer layer of the swimwear to dry and affix the artwork on the outer layer of the swimwear.

The step of providing comprising a step of arranging the outer layer and the inner layer of the swimwear in a predetermined orientation to enhance appearance of the artwork on the outer layer of the swimwear.

Preferably, the outer layer is made of fabric adapted to display the artwork and the outer layer is of white colour.

Preferably, the inner layer is made of fabric which obscure light from passing through the inner layer. Further, the inner layer is in the form of a lining and is of black colour.

The step of drawing comprising a step of providing a marker to a user, enabling the user to draw the artwork on the outer layer of the swimwear. Preferably, the marker is made of, but not limited to, non-toxic material and the artwork is, but not limited to, an image, a character.

The step of heating comprising a step of ironing the outer layer of the swimwear to dry and affix the artwork on the outer layer of the swimwear.

According to another aspect of the invention there is provided a swimwear comprising: an outer layer configured to display an artwork; an inner layer configured to obscure light; wherein the outer layer and inner layer are oriented in a manner to enhance appearance of the artwork on the outer layer and wherein the outer layer is made of fabric adapted to display the artwork wherein the artwork is drawn on the outer layer by a user.

According to another aspect of the invention there is provided a method of customising swimwear, the method comprising the steps of: providing the swimwear having an outer layer and an inner layer; and drawing an artwork on the outer layer of the swimwear to thereby affix the artwork on the outer layer of the swimwear, wherein the step of providing comprises a step of arranging the outer layer and the inner layer of the swimwear in a predetermined orientation to enhance appearance of the artwork on the outer layer of the swimwear and wherein the outer layer is made of fabric adapted to display the artwork and wherein the inner layer is in the form of a lining and is made of fabric which obscures light from passing through the inner layer.

According to another aspect of the invention there is provided swimwear comprising: an outer layer made of fabric adapted to display an artwork drawn thereon by a user; an inner layer made of light obscuring fabric sewn to the outer later, the inner layer and the outer layer being configured so as to enhance appearance of the artwork on the outer layer by substantially preventing light from passing through the inner layer.

It is an advantage of the present invention that, the swimwear and method enables a user to customise the swimwear in accordance with his/her own preferences. The swimwear and method enables a procedure to draw the artwork on the outer layer of the swimwear and ensures enhanced appearance of the artwork by arranging the outer layer and inner layer of the swimwear in a predetermined orientation.

BRIEF DESCRIPTION OF DRAWINGS

At least one example of the invention will be described with reference to the accompanying drawings, in which.

It should be noted that the same numeral represents the same or similar elements throughout the drawings.

DESCRIPTION OF EMBODIMENTS

Figure 1:
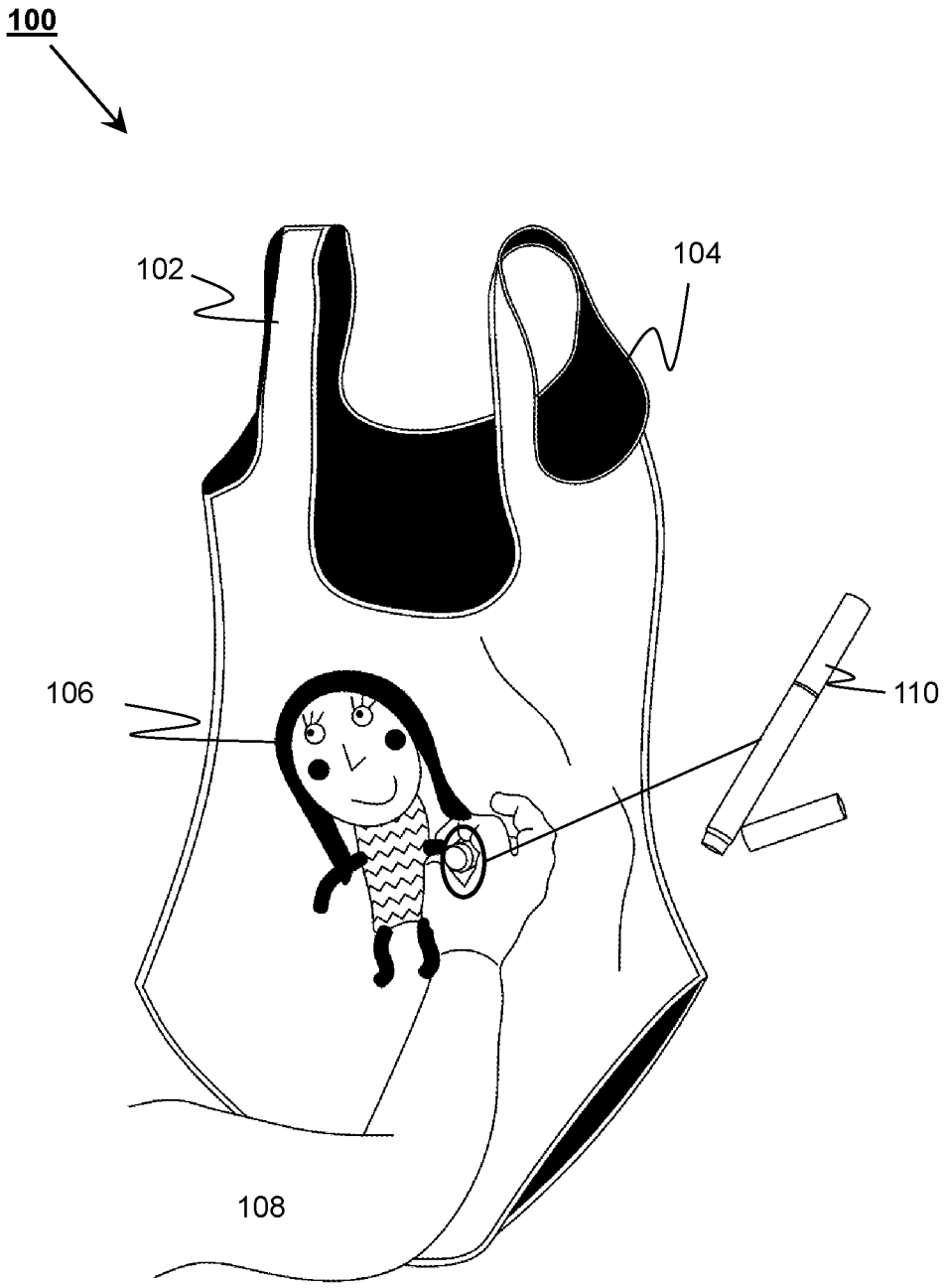
FIG. 1 illustrates a swimwear, in accordance with an embodiment of the present invention.

It is desirable here that there may be provided swimwear which can be customised by a user to display any artwork as per the his/her preference on an outer layer of the swimwear. Further, the disclosed method enables a user to customise the external design of the swimwear. For achieving such an objective the swimwear has an outer layer which is made of fabric adapted to display the artwork and an inner layer which is made of fabric which obscure light from passing through the inner layer. Further, the outer layer and inner layer are oriented in a manner to enhance appearance of the artwork on the outer layer. Also, the present invention facilitates the user to draw the artwork using a particular marker which is made of non-toxic material. Also, the marker is made of a material which ensures permanency of the drawing on the outer layer of the swimwear.

In this regard the invention below has been discussed with the help of figures for clarity. However, a skilled addressee would appreciate that the invention is not limited to particular types of implementations that have been discussed below.

FIG. 1 illustrates swimwear 100, in accordance with an embodiment of the present invention. The swimwear 100 comprises of an outer layer 102 and an inner layer 104.

The outer layer 102 is made of fabric adapted to display an artwork 106. Preferably, the outer layer is of white colour. In another embodiment the outer layer includes one or more of black, blue, purple, orange, brown, pink, yellow, green or red colours or any suitable colour/s as defined by a colour matching system such as the Pantone Matching System (PMS) or the CMYK (Cyan, Magenta, Yellow, Black) 4-colour system or process. However, it is pertinent to mention that the outer layer 102 can be of any material which facilitates display of the artwork 106 and of the colour which enhances display of the artwork 106 on the outer layer 102. The outer layer 102 is preferably water repellent or hydrophobic such that it repels water on contact.

The inner layer 104 is made of fabric which obscure light from passing through the inner layer 106. Further, the inner layer 104 is in the form of a lining and is of black colour. However, it is pertinent to mention that the inner layer 104 can be of any material which assist in blocking light from 1-100% and facilitating improved appearance of the artwork 106 on the outer layer 102. Further, the inner layer 104 can be of any colour which helps in desired appearance of the artwork 106 on the outer layer 102. The inner layer 104 is in the preferred at least slightly, somewhat or mostly water repellent. In another embodiment the inner layer includes one or more of black, blue, purple, orange, brown, pink, yellow, green or red colours or any suitable colour/s as defined by a colour matching system such as the Pantone Matching System (PMS) or the CMYK (Cyan, Magenta, Yellow, Black) 4-colour system or process.

The outer layer 102 and the inner layer 104 are stitched together to form the swimwear 100. However, the outer layer 102 and inner layer 104 may be attached together by any industrial means.

Further, the outer layer 102 and the inner layer 104 are oriented in a manner to enhance appearance of the artwork 106 on the outer layer 102. The orientation of the outer layer 102 and inner layer 104 effects the structural factors of swimwear 100, absorption properties of the energy by the swimwear 100 etc. Further, the predetermined orientation of the outer layer 102 and inner layer 104 can be achieved by different weaving structures and studying yarn-yarn and yarn-projectile friction properties of the fabric.

As shown in FIG. 1, the artwork 106 is drawn by a user 108 by using a marker 110. The artwork 106 may be any artistic work or character or anything which the user 108 wishes to display on the outer layer 102 of the swimwear 100. Further, the user 108 may draw the artwork 106 on front side of the outer layer 102 or back side of the outer layer 102 or on both side of the outer layer 102.

The marker 110 is made of non-toxic material which ensures permanency of the artwork on the outer layer 102 of the swimwear 100. The marker 110 is typically a fabric marker pen which comprises of writing material (ink) in the form of a liquid and having a mass of 6.2 grams. Ideally, the marker 110 may be suitable for use by the user 108 having age of 3 years or above. Further, the marker 108 should conform to health requirements and displays such a statement on the body of the marker 110 clearly visible to the user 108. Also, the marker 110 must not pose any significant chronic adverse health effects to user 108 under normal use or reasonable foreseeable misuse. The marker 110 can be provided in a number of colours such as red, white, orange, yellow, green, brown, blue or any other suitable colour that would be visible on an any appropriately coloured outer layer 102. It would be understood that any suitable ink colour may be used so long as the characteristics of the ink are suitable for drawing on the outer layer 102.

The marker 110 may be a porous-tip ink-marking device of such construction that the ink is held within the marker 110 by an absorbent material and that the marker 110 is resistant to breakage, such that ink will only emerge from the porous writing tip.

Table 1 below provides information about exemplary ingredients of the material of the marker 110:

TABLE 1

| | Ingredient Name | Content of Product (% w/w) |
|---|---|---|
| | Pure Water | 58.6 |
| | Tween 20 | 0.70 |
| | Kojic Acid | 0.70 |
| | Glycerol | 30.00 |
| | May contain the following colorants: | |
| Black | C.I. Pigment Black 5 | 10.00 |
| Red | C.I. Pigment Black 5 | 2.00 |
| | Red 18 | 8.00 |

TABLE 1-continued

| | Ingredient Name | Content of Product (% w/w) |
|---|---|---|
| Blue | Blue 9 | 4.00 |
| | Red 52 | 4.00 |
| | Yellow 23 | 2.00 |
| Yellow | Yellow 23 | 10.00 |
| Green | Blue 9 | 6.00 |
| | Yellow 23 | 4.00 |
| Pink | Pure Water | 65.60 |
| | Red 52 | 3.00 |

Table two below provides information about exemplary safety testing report for marker 110:

Migration of Certain Element: Analysis was performed by Inductively Coupled Argon Plasma—Atomic Emission Spectrometer.

| Element | Method (refer to) 1 | 1 | MDL | Limit |
|---|---|---|---|---|
| Soluble Lead (Pb) | | ND | 5 | 90 |
| Soluble Antimony (Sb) | | ND | 5 | 60 |
| Soluble Arsenic (As) | | ND | 2.5 | 25 |
| Soluble Barium (Ba) | (1) | ND | 10 | 1000 |
| Soluble Cadmium (Cd) | | ND | 5 | 75 |
| Soluble Chromium (Cr) | | ND | 5 | 60 |
| Soluble Mercury (Hg) | | ND | 6 | 60 |
| Soluble Selenium (Se) | | ND | 10 | 500 |

Test Part Description: 1. Red liquid

Note:

1. mg/kg=ppm
2. ND=Not detected
3. MDL=Method Detection Limit

Migration of certain elements requirements of the European Standard, "Safety of toys": Pigmented water-based fabric inks.

TABLE 2

| | Element | | | | | | | |
|---|---|---|---|---|---|---|---|---|
| Sample mg/kg | Arsenic | Barium | Cadmium | Chromium | Mercury | Lead | Antimony | Selenium |
| A: Composite of 70-44-B Red, 70-44-C Blue, 70-44-D Green, 70-44-E Yellow, 70-44-F Orange, 70-44-H Purple paints | LT 15 | 5 | LT 3 | LT 3 | LT 13 | LT 8 | LT 8 | LT 13 |

mg/kg = milligrams per kilogram (ppm = parts per million)

LT = Less Than

Figure 2A:
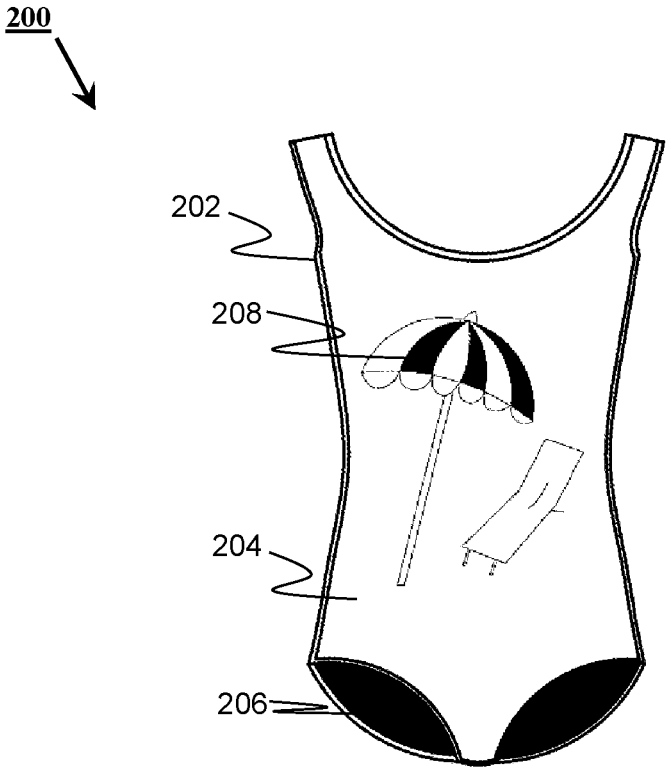
FIG. 2A is a front view of a swimwear for a girl, in accordance with an exemplary embodiment of the present invention.

FIG. 2A is a front view 200 of swimwear 202 for a girl, in accordance with an exemplary embodiment of the present invention. As shown in FIG. 2A, the user 108 has drawn an umbrella and a beach chair as an artwork 208 on the outer layer 204 of the swimwear 202. Further, the inner layer 206 of the swimwear 202 is visible in the front view 200 of the swimwear 202.

Figure 2B:
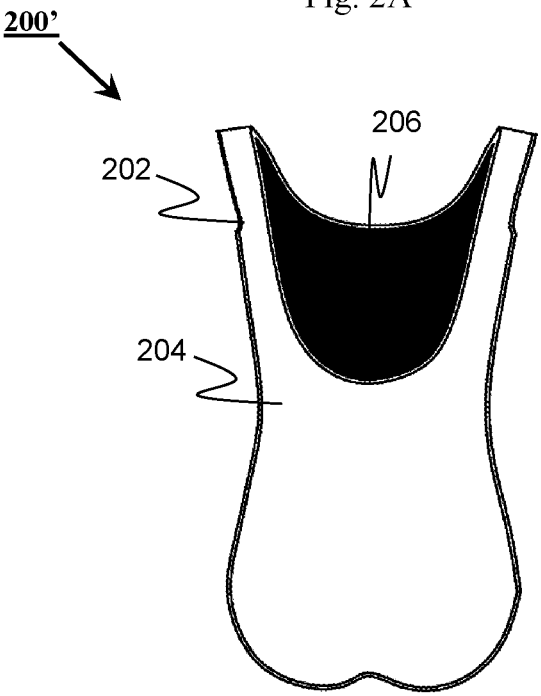
FIG. 2B is a back view of the swimwear for the girl, in accordance with an exemplary embodiment of the present invention.

FIG. 2B is a back view 200' of the swimwear 202 for the girl, in accordance with an exemplary embodiment of the present invention. As shown in FIG. 2B, the user 108 has not drawn any artwork on the outer layer 204 of the swimwear 202. Further, the inner layer 206 of the swimwear 202 is visible in the back view 200' of the swimwear 202. However, the user 108 may draw the artwork 208 on the back side of the swimwear 202.

Figure 3A:
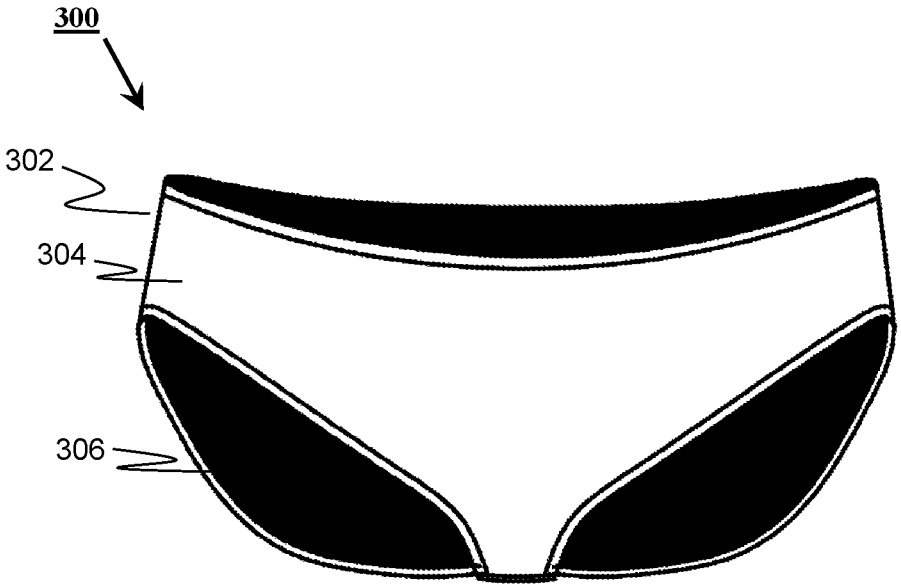
FIG. 3A is a front view of a swimwear for a boy, in accordance with an exemplary embodiment of the present invention.

FIG. 3A is a front view 300 of swimwear 302 for a boy, in accordance with an exemplary embodiment of the present invention. As shown in FIG. 3A, the user 108 has not drawn any artwork on the outer layer 304 of the swimwear 302. Further, the inner layer 306 of the swimwear 302 is visible in the front view 300 of the swimwear 302.

Figure 3B:
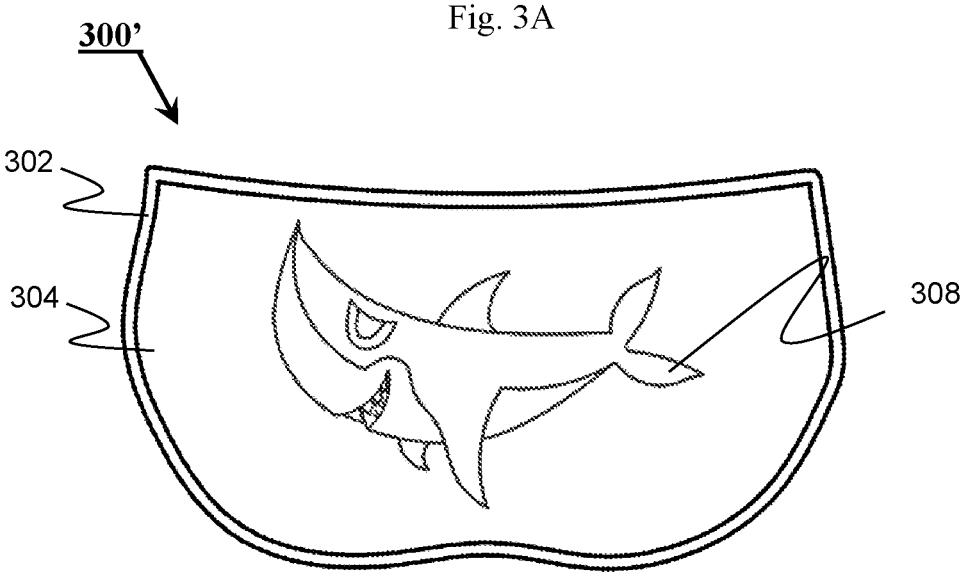
FIG. 3B is a back view of the swimwear for the boy, in accordance with an exemplary embodiment of the present invention.

FIG. 3B is a back view 300' of the swimwear 302 for the boy, in accordance with an exemplary embodiment of the present invention. As shown in FIG. 3B, the user 108 has drawn a shark as an artwork 308 on the outer layer 304 of the swimwear 302. However, the user 108 may draw the artwork 308 on the front side of the swimwear 302.

Figure 3C:
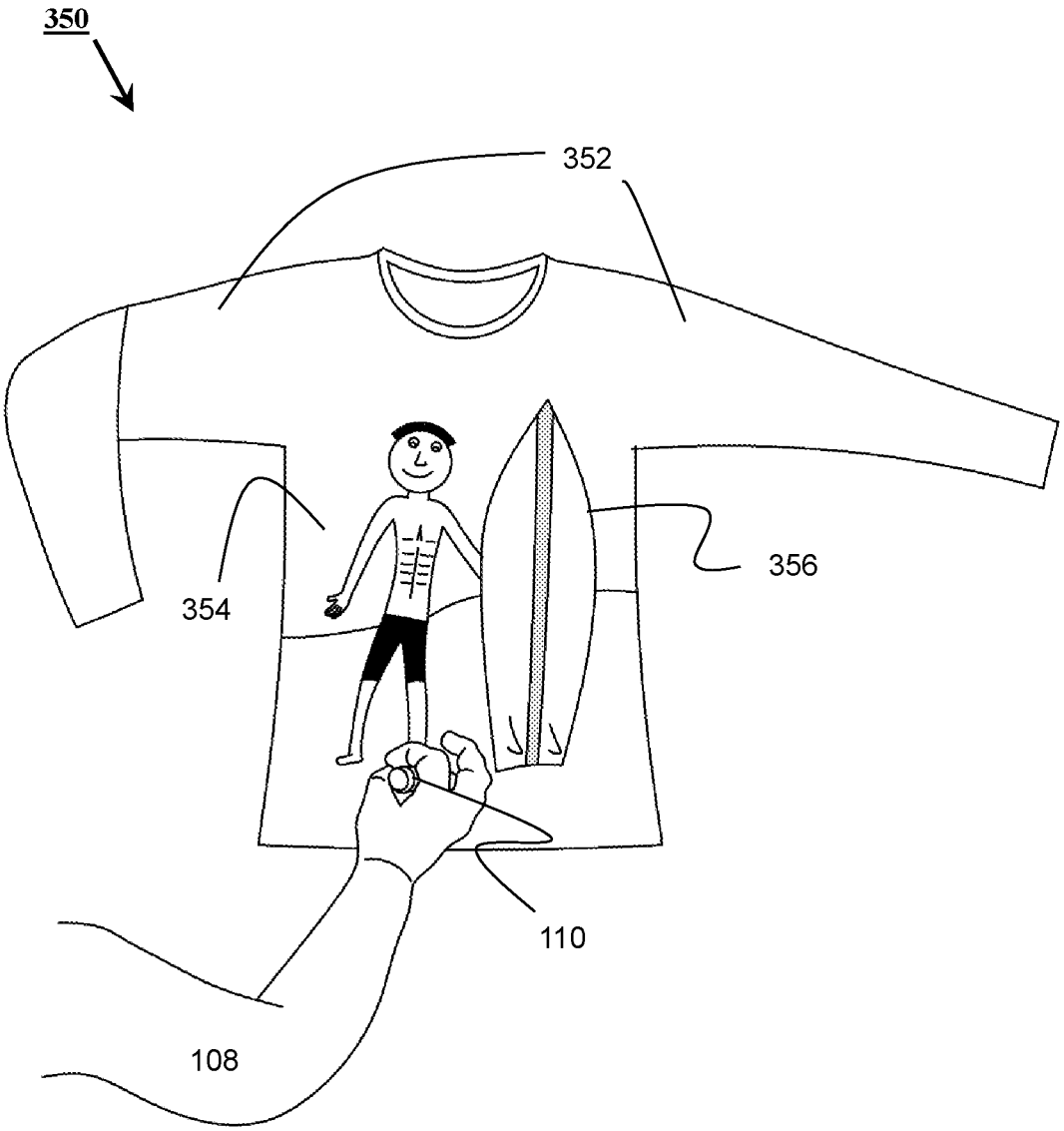
FIG. 3C is a front view of the rash vest swimwear, in accordance with an exemplary embodiment of the present invention.

FIG. 3C is a front view of the rash vest swimwear, in accordance with an exemplary embodiment of the present invention. As shown in FIG. 3C, the rash vest swimwear 350 has a front side 354 and a couple of sleeves 352 adapted to cover the upper body and prevent rashes. The user 108 has drawn a boy standing with his surf board on a beach as an artwork 356 on the outer layer 354 of the swimwear 350. However, the user 108 may draw the artwork 308 on the back side (not shown) of the swimwear 350 as well.

Figure 5:
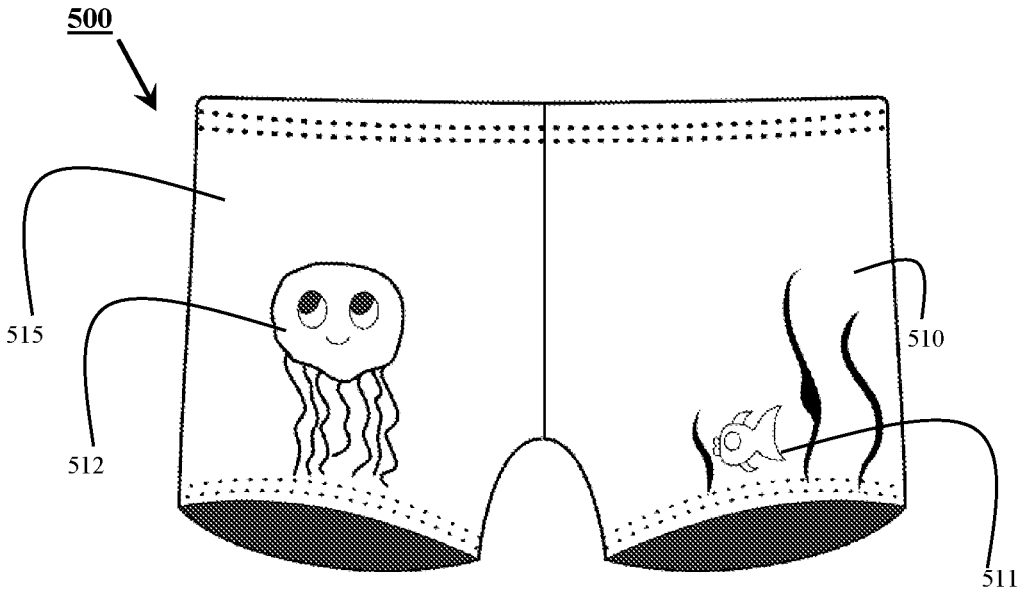
FIG. 5 illustrates a method of customising a swimwear, in accordance with an embodiment of the present invention.

FIG. 5 is a front view of swimming shorts swimwear, in accordance with an exemplary embodiment of the present invention. As shown in FIG. 5, the swimming shorts 500 have a front side 510. The user 108 has drawn a fish 511 and an octopus 512 as artwork on the outer layer 515 of the swimming shorts 500.

Figure 6:
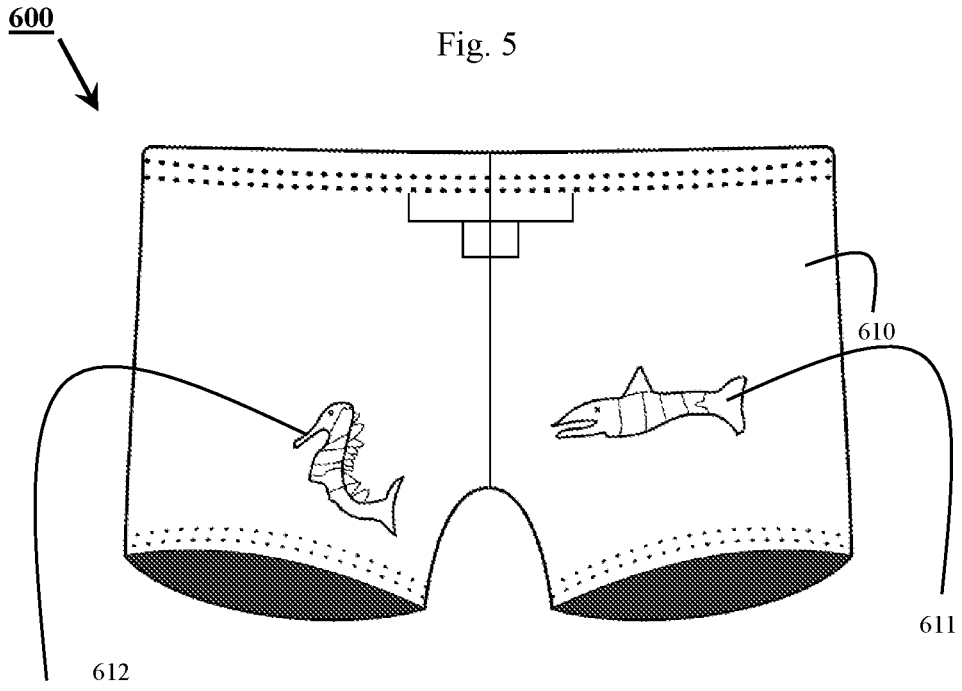
FIG. 6 illustrates a method of customising a swimwear, in accordance with an embodiment of the present invention.

FIG. 6 is a back side view of swimming shorts swimwear, in accordance with an exemplary embodiment of the present invention. As shown in FIG. 6, the swimming shorts 600 have a back side 610. The user 108 has drawn a fish 611 and a sea horse 612 as artwork on the outer layer 615 of the swimming shorts 615.

Figure 4:
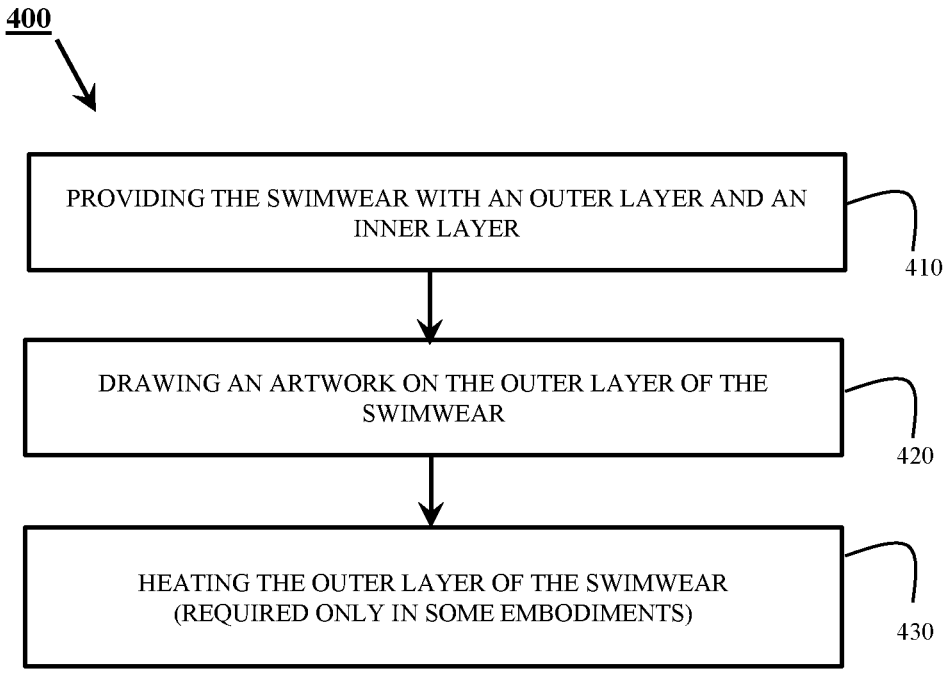
FIG. 4 illustrates a method of customising a swimwear, in accordance with an embodiment of the present invention.

FIG. 4 illustrates a method 400 of customising swimwear 100, in accordance with an embodiment of the present invention. The method starts at step 410 when a swimwear 100 having an outer layer 102 and an inner layer 104 is provided.

The outer layer 102 of the swimwear 100 is made of fabric adapted to display an artwork 106. Preferably, the outer layer is of white colour. However, it is pertinent to mention that the outer layer 102 can be of any material which facilitates display of the artwork 106 and of the colour which enhances display of the artwork 106 on the outer layer 102.

The inner layer 104 is made of fabric which obscure light from passing through the inner layer 104. Further, the inner layer 104 is in the form of a lining and is of black colour. However, it is pertinent to mention that the inner layer 104 can be of any material which assist in blocking light from 1-100% and facilitating improved appearance of the artwork 106 on the outer layer 102. Further, the inner layer 104 can be of any colour which helps in desired appearance of the artwork 106 on the outer layer 102.

The outer layer 102 and the inner layer 104 are stitched together to form the swimwear 100. However, the outer layer 102 and inner layer 104 may be attached to together by any industrial means.

The step 410 further comprising a step of arranging the outer layer 102 and the inner layer 104 in a predetermined orientation in a manner to enhance appearance of the artwork 106 on the outer layer 102. The orientation of the outer layer 102 and inner layer 104 effects the structural factors of swimwear 100, absorption properties of the energy by the swimwear 100. Further, the predetermined orientation of the outer layer 102 and inner layer 104 can be achieved by different weaving structures and studying yarn-yarn and yarn-projectile friction properties of the fabric.

Thereafter at step 420 the artwork 106 is drawn on the outer layer 102 of the swimwear 100 by a user 108. The step 420 comprising a step of providing a marker 110 to the user 108 enabling the user 108 to draw the artwork 106 on the outer layer 102 of the swimwear 100. Preferably, the marker 110 is made of, but not limited to, non-toxic material and the artwork 106 is, but not limited to, an image, a character.

In a less preferred embodiment, depending on the markers chosen, the ink may be required to be heated to ensure it does not run or smudge. It is preferred that appropriate drying markers are chosen to prevent the need to heat, however, this may be required in some embodiments according to ink availability and quality. At the step 430, heating of the outer layer 102 is carried out in order to dry and affix the artwork 106 drawn by the user 108 on to the outer layer 102 of the swimwear 100. The step 430 comprising a step of ironing the outer layer 102 of the swimwear 100 to dry and affix the artwork 106 on the outer layer 102 of the swimwear 100. Further, the ironing is done on the inner side (not shown) of the outer layer 102 in order prevent any damage to the artwork 106. It is pertinent to mention that the heating of the outer layer 102 may be performed by any other means. In some embodiments, depending on the composition of the markers, heating may not be required.

In the preferred embodiment it would be understood that the outer layer and inner layer are oriented in a manner to enhance appearance of the artwork on the outer layer in the manner described above. The image on the outer layer is enhanced by presence of the inner layer which acts as a backing so as to accentuate or make the image drawn on the outer layer be displayed more clearly and/or stand out more and/or become more vibrant and/or enhanced in another manner according to the particular colours chosen for each the inner and outer layers. Depending on the colours chosen for each layer this could be by way of the inner layer obscuring or blocking light in the case of a black inner layer or by accentuating the image in another manner by choosing inner layers colours that act as backings to the image drawn on the outer layer.

In another preferred embodiment the ink in the markers comprises a washable marker ink composition such as that described in U.S. 7,455,725 B2.

In another preferred embodiment the ink in the markers is water soluble such that the image drawn on the outer layer can be removed by way of washing the swimwear in water and agitating the image to remove the ink. In this manner the user can remove the image previously drawn on the swimwear and choose to draw a new image on the swimwear when desired.

In another preferred embodiment the invention provides swimwear comprising an outer layer made of fabric adapted to display an artwork drawn thereon by a user and an inner layer made of light obscuring fabric sewn to the outer later, the inner layer and the outer layer being configured so as to enhance appearance of the artwork on the outer layer by substantially preventing light from passing through the inner layer. Preferably the outer layer is substantially white or another light colour such as cream which is adapted to display an image drawn thereon by the user. Preferably the inner layer is substantially black or another dark colour such as navy which is adapted to obscure light.

It should be understood that the techniques of the present disclosure might be implemented using a variety of technologies. For example, the drawing of the artwork described herein may be carried out by a particular machine using the material of the marker. The predetermined orientation of the outer layer and the inner layer of the swimwear may be determined on the basis of the fabric type, use type, marker material type etc.

The claims defining the invention are as follows:

1. A kit for use in creating customized swimwear, the kit comprising:

a) an article of clothing for use as swimwear comprising:

an outer layer formed of a water repellent, draw-on fabric, the draw-on fabric being white in color and enabled for a water soluble ink to be drawn and remain non-permanently thereon, whereby the outer layer is configured to display an artwork, and wherein the outer layer fabric is a first fabric formed by a first weaving structure;

an inner layer formed of a water repellent fabric being black in color and configured to prevent passage of the water soluble ink and block at least about 98% of light from passing therethrough, wherein the outer layer and inner layer are oriented in a manner to obscure light from passing through the inner layer to enhance the appearance of the artwork on the outer layer, and wherein the inner layer fabric is a second fabric having a second weaving structure different from the first weaving structure; and b) a plurality of fabric markers of different colors, each respective marker comprising: a porous-tip ink-marking device for drawing on the outer layer of the swimwear; and an ink reservoir having an absorbent material for holding non-toxic ink within the marker, wherein the porous-tip is configured whereby the ink emerges from the porous-tip responsive to being used in drawing on the outer layer of the swimwear.

2. The kit according to claim 1 wherein the fabric markers contain water soluble ink.

3. The kit according to claim 2 where artwork can be removed by agitating the ink while immersed in water.

4. The kit according to claim 2 where in the fabric markers contain a permanent ink.

* * * * *